United States Patent [19]

Hayama et al.

[11] 4,299,104

[45] Nov. 10, 1981

[54] METHOD OF CONTROLLING ROLL ECCENTRICITY OF ROLLING MILL AND APPARATUS FOR PERFORMING THE SAME METHOD

[75] Inventors: Yasunobu Hayama; Kuniaki Tanouchi; Mitsuhiro Abe; Katsuhiro Ohkura, all of Hiroshima, Japan

[73] Assignee: Mitsubishi Jukogyo Kabushiki Kaisha, Tokyo, Japan

[21] Appl. No.: 123,415

[22] Filed: Feb. 21, 1980

[30] Foreign Application Priority Data

Feb. 28, 1979 [JP] Japan ..... 54/23161

[51] Int. Cl.[3] ..... B21B 37/08

[52] U.S. Cl. ..... 72/20

[58] Field of Search ..... 72/6, 8, 16, 20, 19

[56] References Cited

U.S. PATENT DOCUMENTS 3,795,124 3/1974 Diolot ..... 72/20

3,893,317 7/1975 Clarke ..... 72/20

3,920,968 11/1975 Imai et al. ..... 72/8 X

*Primary Examiner*—Milton S. Mehr

*Attorney, Agent, or Firm*—Toren, McGeady & Stanger

[57] ABSTRACT

A method of controlling roll eccentricity of a rolling mill is disclosed, in which a component of a rolling load variation which is due to eccentricities of an upper and a lower backup rolls of the rolling mill is obtained as a first eccentricity compensation signal by removing a rolling load variation component due to a variation of thickness of a material to be rolled from a rolling load variation occurred during the rolling operation, a rolling load variation value due to the roll eccentricity of the backup rolls is obtained from a rolling load variation occurred during rotations of work rolls which are in contact with each other under a load and is memorized as a second roll eccentricity compensation signal, a first signal is obtained by multiplying the first roll eccentricity compensation signal with a coefficient which is larger than 0 and smaller than 1, a second signal is obtained by multiplying the second roll eccentricity compensation signal with another coefficient which is larger than 0 and smaller than 1, and the first and second signals are added to obtain a roll eccentricity compensation signal for the rolling mill. An apparatus for performing the same method is also disclosed.

5 Claims, 9 Drawing Figures

METHOD OF CONTROLLING ROLL ECCENTRICITY OF ROLLING MILL AND APPARATUS FOR PERFORMING THE SAME METHOD

BACKGROUND OF THE INVENTION

1. Field of the Invention

The present invention relates to a method of controlling roll eccentricity of a rolling mill and an apparatus for performing the same.

2. Description of the Prior Art

In the thickness control of a rolling mill, it is difficult theoretically to remove a rolling load variation due to an eccentricity of backup rolls thereof by using the conventional gaugemeter method or the X ray thickness meter having feedback system. In order to overcome the difficulty, it has been proposed to estimate a rolling load variation due to the eccentricity of the backup rolls correspondingly to a rotation angle of the rolls and to preliminarily control the rolling mill on the basis of the estimated value. The latter method is disclosed, for example, in Japanese Patent Publication No. 53-16386 and Japanese Patent Application Laid-open No. 52-65158 both of which are assigned to the assignee of the present application. The methods disclosed in the Japanese Patent Publication and the Japanese Patent Application Laid-open will now be briefly described by referring them as first control method and second control method, respectively.

The first control method;

The first control method is practicized by using an apparatus shown in FIG. 1. That is, in a first roll rotation period, a pulse signal obtained by a pulse generator 12 directly connected to an upper backup roll 1 and an output signal of a load cell 9 which functions to detect a rolling load variation are supplied to a roll eccentricity control device 11. In the roll eccentricity control device 11, the pulse signal is converted into a rotation angle $\theta_T$ of the backup roll 1 and a rolling load variation value $V_1(\theta_T)$ which is due to eccentricity of the upper and a lower backup rolls 1 and 4 is obtained from the output signal of the load cell 9 as a function of the rotation angle $\theta_T$, with using a process to be described.

In a second roll rotation period, the rolling load variation value $V_1(\theta_T)$ obtained in the first period is used as a roll eccentricity compensation signal for the rolling mill. That is, the rolling load variation value $V_1(\theta_T)$ which is an output of the control device 11 is supplied to a rolling force control device 10 of oil pressure type to control a rolling force cylinder 6 through a servo valve 8 to thereby compensate for the rolling load variation due to the eccentricity of the rolls.

A rolling load variation value $V_2(\theta_T)$ is also obtained in the second period as in the first period. A sum of the rolling load variation values $V_1(\theta_T)$ and $V_2(\theta_T)$ is used in a third roll rotation period as a roll eccentricity compensation signal for the rolling mill for that period.

Therefore, in n-th roll rotation period, a roll eccentricity compensation signal to be used to control the rolling mill becomes $V_1(\theta_T)+V_2(\theta_T)+\ldots+V_{n-2}(\theta_T)+V_{n-1}(\theta_T)$.

In FIG. 1, reference numerals 2 and 3 show the work rolls, 7 shows a deviation meter for detecting a deviation of the rolling force cylinder 6 and 5 shows a sheet material to be rolled.

FIG. 2 shows a method of obtaining from the output signal of the load cell 9 the rolling load variation values $V_1(\theta_T)$, $V_2(\theta_T)$ . . . which are due to the roll eccentricity. The output signal of the load cell 9 has a waveform including a rolling load variation component 2B due to the thickness variation of the sheet material 5 to be rolled superimposed with a rolling load variation component 2C due to the roll eccentricity which is shown in a lower part of the same figure. Therefore, in order to obtain the rolling load variation component 2C, it is necessary to subtract the rolling load variation component 2B from the output signal 2A of the load cell 9. The subtraction may be performed as follow.

Since the rolling load variation 2B due to the thickness variation of the sheet material 5 changes slowly with respect to the output signal 2A of the load cell 9 as will be clear from FIG. 2, the change may be proximated as being linear with the rotations of the backup rolls 1 and 4.

Further, the rolling load variation due to the roll eccentricity in an interval $T_2$ during which the backup rolls 1 and 4 are rotated by one revolution, respectively, is obtained by subtracting components shown by linear lines A-B in the same figure from the output signal of the load cell 9 during the same interval. This is performed as follow. That is, components shown by linear line A'—B' is subtracted firstly from the output signal of the load cell 9 and then a mean value of the result is subtracted from the result. A result of the last subtraction is the rolling load variation component due to the roll eccentricity in the interval.

In other words, the first control method comprises the steps of obtaining the rolling load variation due to the roll eccentricity during the rolling operation of the sheet material 5 and utilizing the variation as the roll eccentricity compensation signal for the rolling mill. Therefore, this method is advantageous in that it can respond to changes of rolling conditions due to such as wear, damage or expansion of the rolls 1 and 4 or exchange of them. However, since this method can not completely exclude influences of the rolling load variation due to the thickness variation of the sheet material to be rolled, there is a limit in control in this sense.

The second control method;

The second control method may be practicized by using an apparatus shown in FIG. 3. That is, the method comprises the steps of rotating the work rolls 2 and 3 without the sheet material 5, i.e., with the rolls 2 and 3 being in contact with each other under a load, obtaining rolling load variations due to the eccentricity of the backup rolls 1 and 4, respectively, from the rolling load variation obtained from the load cell 9, memorizing the variations thus obtained respectively and utilizing the memorized data as the roll eccentricity compensation signal during the rolling operation. The apparatus in the same figure further comprises another pulse generator 13 related to the lower backup roll 4 because it is also necessary to detect the rolling load variations due to the lower backup roll eccentricity. The second control method will be described in more detail on the way of description of the present invention.

In any way, since in the second control method, the rolling load variation value due to the roll eccentricity is obtained under the condition of direct contact of the work rolls 2 and 3, the value is not influenced by the thickness variation of the sheet material 5 to be rolled. However, the rolling conditions under which the rolling load variation value is detected differ from those under which the rolling mill is actually controlled according to the value detected and, therefore, there may be control errors. That is, the second control method can not respond to changes in shape of the backup rolls 1 and 4 due to wear, damage or expansion thereof with time.

SUMMARY OF THE INVENTION

An object of the present invention is to provide a method of controlling roll eccentricity of a rolling mill, which has the merits of the aforementioned first and second control method while a precise compensation for the rolling load variation due to the roll eccentricity is achieved.

Another object of the present invention is to provide an apparatus for practicing the above method.

In order to achieve the above objects, according to the present invention, a rolling load variation component due to the eccentricity of the upper and lower backup rolls is obtained by removing a rolling load variation component due to a thickness variation of a sheet material to be rolled from a rolling load variation signal obtained during a rolling operation as a first roll eccentricity compensation signal and a rolling load variation value due to roll eccentricities of the respective backup rolls is obtained from a rolling load variation detected under condition that an upper and lower work rolls are made in contact with each other under load and rotated. The rolling load variation value is memorized as a second roll eccentricity compensation signal. A data which is a sum of a signal obtained by multiplying the first roll eccentricity compensation signal with a coefficient larger than 0 and smaller than 1 and a signal obtained by multiplying the second roll eccentricity compensation signal with a coefficient larger than 0 and smaller than 1 is utilized as a roll eccentricity compensation signal for a rolling mill.

The above and other objects and features of the present invention will become apparent from the following description with reference to the attached drawings.

DETAILED DESCRIPTION OF PREFERRED EMBODIMENTS:

In the present invention, a sum of a signal obtained by multiplying the first roll eccentricity compensation signal $V(\theta_T)$ used in the previously mentioned first control method with a coefficient larger than 0 and smaller than 1 and a signal obtained by multiplying the second roll eccentricity compensation signal $u(\theta_T, \theta_B)$ used in the previously mentioned second control method with a coefficient larger than 0 and smaller than 1 is used as a roll eccentricity compensation signal for the rolling mill.

For example, in the following embodiments, a weighted mean of the signals $V(\theta_T)$ and $u(\theta_T, \theta_B)$, i.e., $\alpha \cdot u(\theta_T, \theta_B) + (1-\alpha) \cdot V(\theta_T)$, is used as the roll eccentricity compensation signal for the rolling mill, where $\theta_T$ and $\theta_B$ are rotation angles of the respective backup rolls and $\alpha$ is a value defined as $0<\alpha<1$.

When the rolling mill is controlled by using the above roll eccentricity compensation signal, the control preciseness is improved in comparison with that obtainable by using only the signal $V(\theta_T)$ (i.e., $\alpha=0$) or that obtainable by using only the signal $u(\theta_T, \theta_B)$ (i.e., $\alpha=1$). This is because the method and apparatus according to the present invention have the merits of both the first and second control method.

Figure 1:
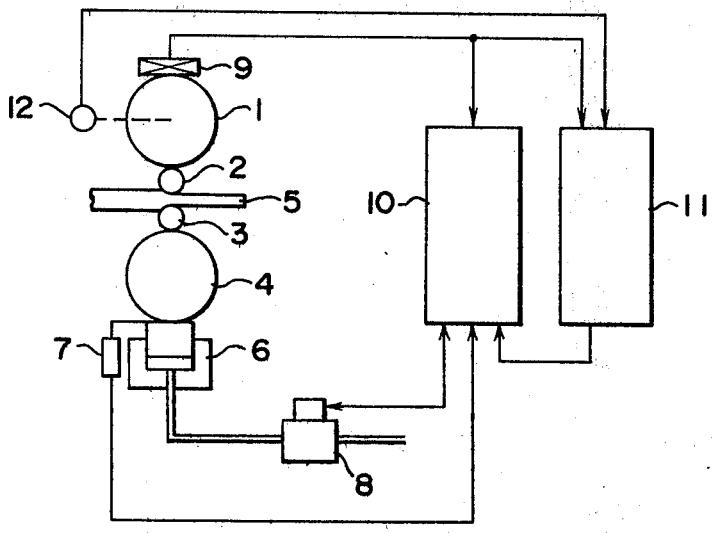
FIG. 1 PRIOR ART
FIG. 1 illustrates schematically one example of a conventional roll eccentricity control apparatus for a rolling mill.
Figure 2:
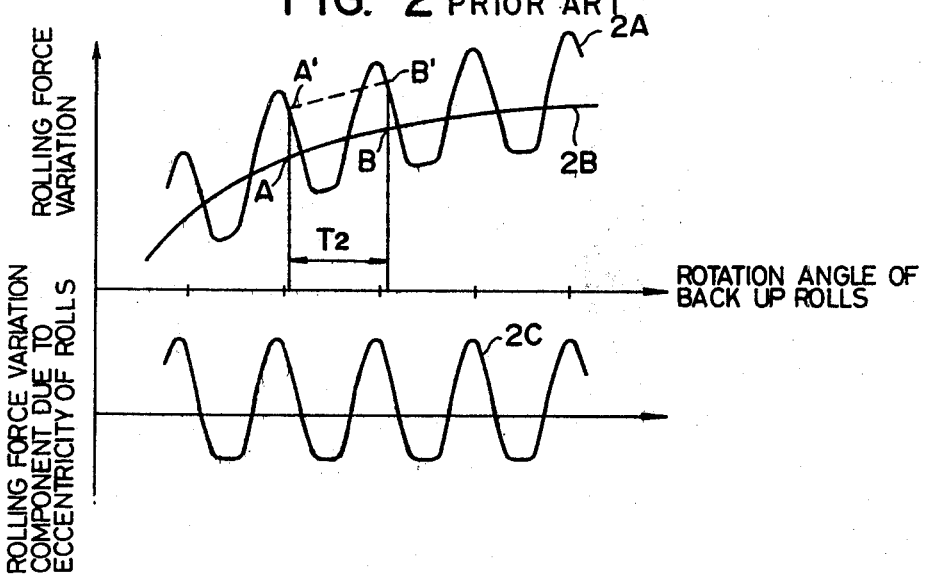
FIG. 2 PRIOR ART
FIG. 2 shows a signal waveform of an output of a load cell of the apparatus in FIG. 1, a waveform of the rolling load variation due to thickness variation of a sheet material to be rolled, which is included in the signal waveform, and a waveform of the rolling load variation due to the roll eccentricity, which is included in the signal waveform.
Figure 3:
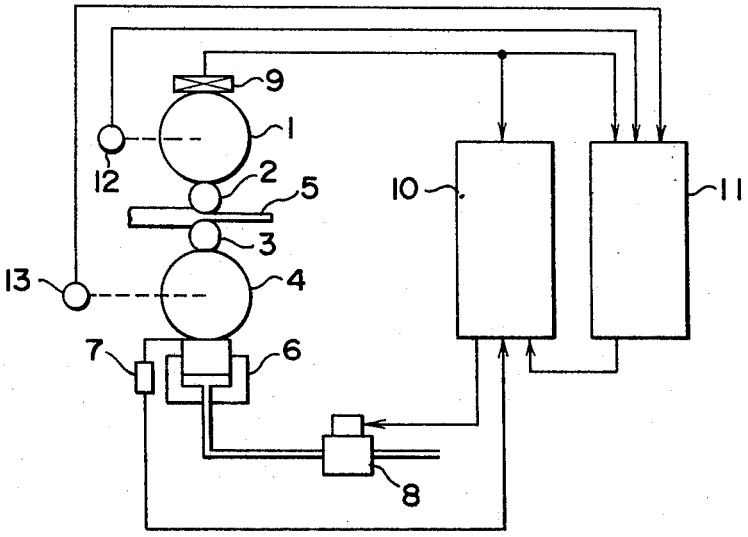
FIG. 3 PRIOR ART
FIG. 3 illustrates another example of the conventional roll eccentricity control device.
Figure 4:
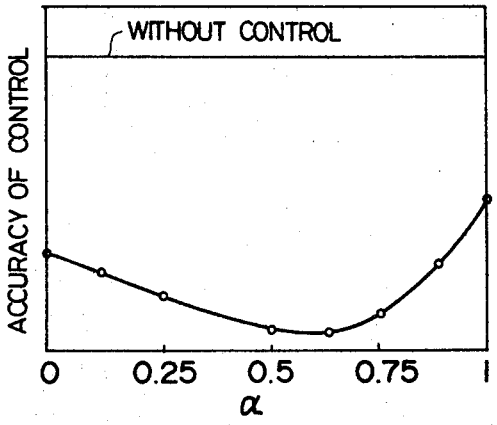
FIG. 4 is a graph showing the control precision obtainable when the present method and apparatus are used.
Figure 5:
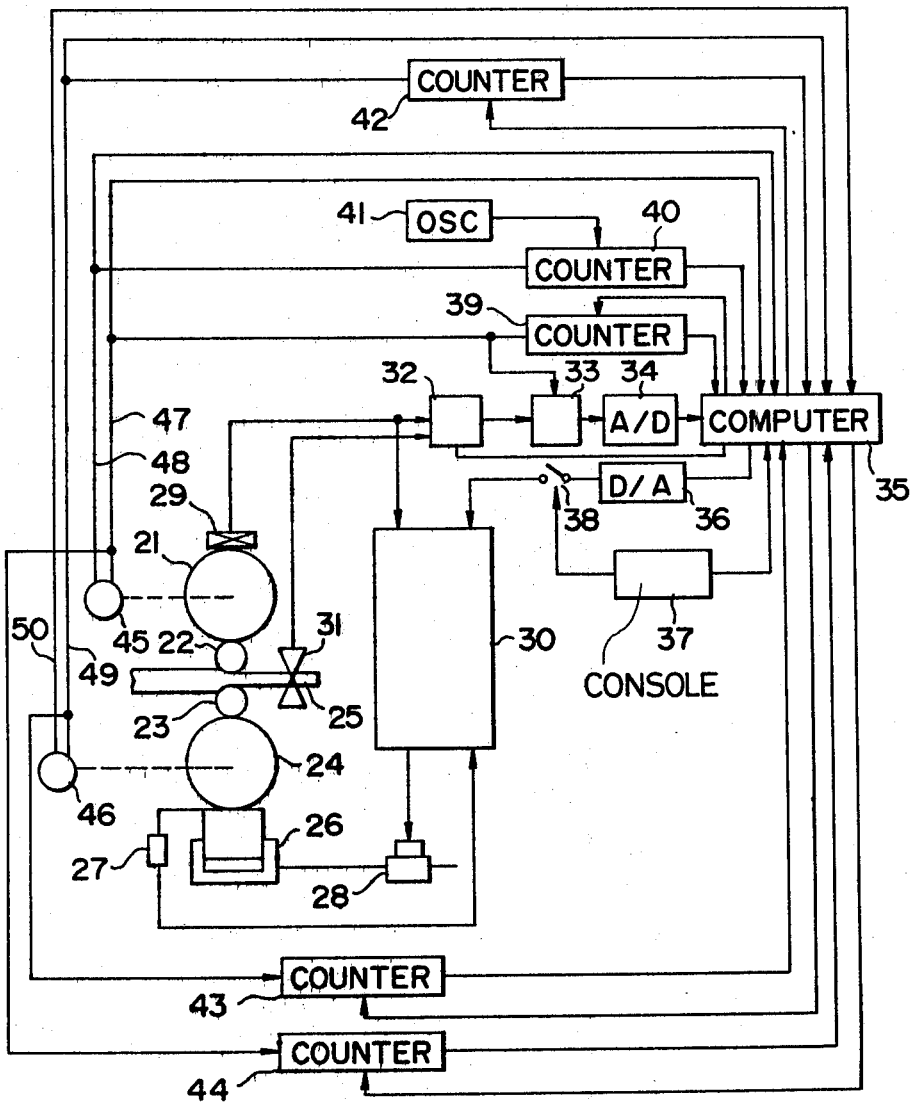
FIG. 5 is a block diagram showing one embodiment of the present roll eccentricity control apparatus.

FIG. 5 shows one example of the apparatus for performing the method of controlling roll eccentricity according to the present invention. In the same figure, reference numerals 22 and 23 are work rolls and a sheet material 25 is rolled by and between these rolls and reference numerals 21 and 24 are an upper and lower backup rolls, respectively, for pressurizing the work rolls 22 and 23. A reference numeral 26 is a rolling force cylinder which supports the lower backup roll 24. The cylinder 26 functions to control the thickness of the sheet material 25 by changing a gap between the work rolls 22 and 23.

A reference numeral 27 is a deviation meter for detecting a deviation of the rolling force cylinder 26 and a reference numeral 29 is a load cell for detecting the variation of the rolling load. Outputs of the deviation meter 27 and the load cell 29 are supplied to an oil pressure type rolling force control device 30 whose output is supplied to a servo valve 28. With this arrangement, a control system of the so-called gauge meter type is constructed.

Reference numerals 45 and 46 are pulse generators directly connected to the backup rolls 21 and 24, respectively 60 pulses, for example, are provided at each of lead wires 47 and 49 from the generators 45 and 46 for one revolution of the rolls 21 and 24 and 1 pulse, for example, is provided at each of lead wires 48 and 50 for each revolution of them. A reference numeral 32 shows a multiplexer which receives the output signals of the load cell 29 and the thickness detecter 31 and provides an output which is supplied to a digital computer 35 through a sample holder 33 and an A/D converter 34. The sample holder 33 samples the output of the multiplexer in synchronism with the pulse signal of the pulse generator 45 on the lead wire 47.

Reference numerals 39 and 42 are counters which count the pulse signals on the lead wires 47 and 49 from the pulse generators 45 and 46, respectively to detect the rotation angles of the backup rolls 21 and 24. The counters 39 and 42 are reset by a signal provided by the computer 35. A reference numeral 40 is a counter which counts the pulse signal provided by the pulse generator 45 on the lead wire 48 and which is set and reset a signal having a constant time interval, the latter signal being produced by an oscillator 41. The content of the counter 40 corresponds to a rotation frequency of the upper backup roll 21 and is used as a data for compensating for a delay in the control system. Reference numerals 43 and 44 designate counters which count pulses provided on the lead wires 49 and 47, respectively. The counters 43 and 44 are capable of counting continuously the pulses during several to several tens revolutions of the backup rolls 21 and 24, respectively. The purpose of the provision of the counters 43 and 44 is to calculate a difference in diameter between the backup rolls 21 and 24. These counters are set and reset upon the output signal of the computer 35.

A reference numeral 37 designates a console for providing instructions to various clements of the control apparatus through push button switches etc. thereof. For example, upon a depression of one of the push button switches, a contact of a relay 38 is controlled. The relay 38 is disposed between the D/A converter 36 for converting the roll eccentricity compensation signal supplied from the computer 35 into an analog signal and the oil pressure rolling force control device 30. Therefore, only when the contact of the relay 38 is closed upon the instruction from the console 37, the roll eccentricity compensation signal is supplied to the rolling force control device 30.

As mentioned previously, the roll eccentricity control method according to the present invention compensate for the rolling load variation due to the roll eccentricity by utilizing both of the previously mentioned first and second control methods. Therefore, prior to a description of the operation of the present invention, the principle of the roll eccentricity control according to the second control method will be described in detail.

Referring to the rolling load variation values due to the roll eccentricity of the upper backup roll 21 and due to the roll eccentricity of the lower backup roll 24 as $f_i$ and $g_j$, respectively, the load cell 29 will detect a rolling load variation value $f_i+g_j$ under the condition that there is no sheet material 25 supplied, i.e., the work rolls are in kissed condition, where suffixes i, j designate the counts of the counters 39 and 42, i.e., the rotation angles of the backup rolls 21 and 24, respectively.

For clarification of description the following two assumptions a and b are employed. It should be noted, however, these assumptions do not constitute the conditions on which the second control method is established.

a; The diameter of the upper backup roll 21 is larger than that of the lower backup roll 24.

b; The rolling load variation values $f_i$, $g_j$ due to the eccentricities of the backup rolls 21 and 24 change sinusoidably, respectively.

Figure 6:
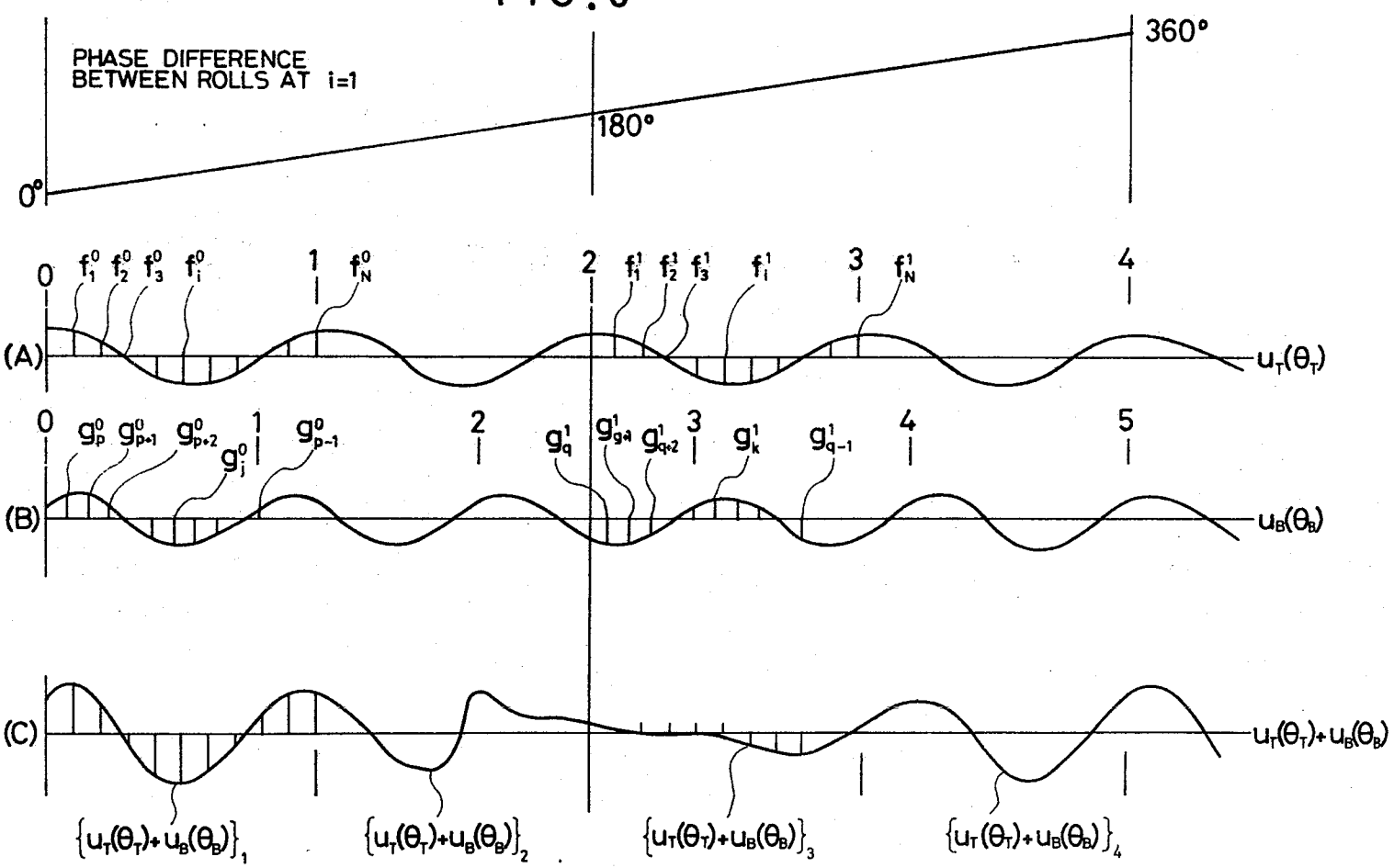
FIGS. 6(A) and 6(B) are graphs showing the rolling load variations due to the eccentricities of the upper and lower backup rolls.
FIG. 6(C) is a graph showing a composite waveform including the waveforms in FIGS. 6(A) and 6(B)

For example, when the ratio of the diameters of the backup rolls 21 and 24 is 5:4, the rolling load variation values $f_i$ and $g_j$ will change as shown in FIGS. 6(A) and 6(B), respectively, for example. That is, these values $f_i$, $g_j$ will coincide with those when the backup roll 21 completes four revolutions and the backup roll 24 completes five revolutions, respectively. In other words, the phase difference between the waveforms in FIGS. 6(A) and 6(B) (the phase difference will be referred to "between-rolls phase difference", hereinafter) becomes 360° at a time when the upper backup roll 21 completes four revolutions. Therefore, the value $f_i+g_j$ detected by the load cell 29 varies as shown in FIG. 6(C) and this is repeated for each four revolutions of the roll 21.

The rolling load variation values $f_i$ and $g_j$ which change as shown in FIGS. 6(A) and 6(B) and which are unknown can be determined from the output of the load cell 29 which is shown in FIG. 6(C) in such a way as described below. That is, with using the above mentioned between-rolls phase difference, the following two data are obtained from the output of the load cell 29, $$f_i^o+g_j^o=a_i(i, j=1, 2, 3 \ldots, N) \ldots \quad (1)$$

$$f_i^l+g_k^l=b_i(i, k=1, 2, 3, \ldots, N) \ldots \quad (2)$$

where N is the number of pulses generated by the pulse generators 45 and 46 during one revolution of the backup rolls 21 and 24, the interval between the pulses being shown in FIGS. 6(A) and 6(B), the values with suffix 0 are the data obtained in a range of the between-roll phase difference of 0°–180° and those with suffix 1 are the data obtained in a range of the between-roll phase difference of 180°–360°.

Considering now the phase difference between the values $f_1^o$ and $f_1^l$ on the waveform (A), it is 360°×2. In the similar manner, the phase differences between $f_2^o$ and $f_2^l$, $f_3^o$ and $f_3^l$, . . . and $f_N^o$ and $f_N^l$ are 360°×2, respectively. This means $f_1^o=f_1^l$, $f_2^o=f_2^l$, $f_3^o=f_3^l$, . . . , $f_N^o=f_N^l$ and, therefore, the values $f_i^o$ and $f_i^l$ represented in the equations (1) and (2) are equal to each other. That is, $$f_i^o=f_i^l \quad \ldots (3)$$

Therefore, the following equation is obtained from the equations (1), (2) and (3).

$$g_j^o=g_k^l=a_i-b_i \quad \ldots (4)$$

The phase difference between $g_j^o$ and $g_k^l$ is 360°×2+180°=900° as will be clear from the waveform in FIG. 6(B) and, therefore the left term of the equation (4) can be rewritten as follow:

$$g_{jo}-g_k^l=2g_j^o \quad \ldots (5)$$

Consequently, the following equation is obtained from the equations (4) and (5).

$$g_j^o=\tfrac{1}{2}(a_i-b_i) \quad \ldots (6)$$

Figure 7:
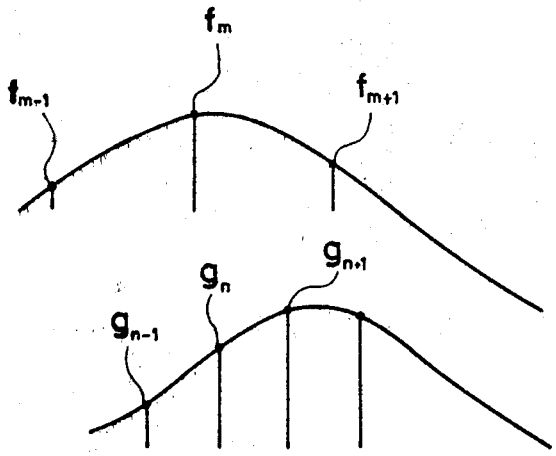
FIG. 7 shows a timing of pulses generated by two pulse generators.

As to the suffix j of the value $g_j^o$, it is necessary to know the followings: That is, the output signal $f_i+g_j$ of the load cell 29 is sampled by the sampler 33 and then written in the digital computer 35 together with the contents i and j of the counters 39 and 42. That is, the computer 35 is supplied with three kinds of data, $f_i=g_j$, i and j for each sampling. Since, however, the diameters of the backup rolls 21 and 24 are different, there is a case where the pulse generator 46 for the lower backup roll 24 produces two pulses during one sampling period of the sampling pulse from the pulse generator 45. That is, there is a case where j varies from j=n−1 to j=n+1 when i varies from i=m to i=m+1, as shown in FIG. 7.

| i | j |
|---|---|
| m | n − 1 |

-continued

| m + 1 | n + 1 |
|---|---|

In such case as above, it is impossible to obtain a value $s_{gn}$ corresponding to j=n from data obtained by sampling it with i. In order to obtain the value $s_{gn}$, the following considerations are to be made. According to the equation (6), values $g_{n-1}$ and $g_{n+1}$ shown in the same figure can be represented as follow.

$$g_{n-1}=\tfrac{1}{2}(a_m-b_m)$$

$$g_{n+1}=\tfrac{1}{2}(a_{m+1}-b_{m+1})$$

Since the value $g_n$ can be assumed as on a linear line connecting the values $g_{n-1}$ and $g_{n+1}$, it is possible to consider that $g_n$ is a mean value of the values $g_{n-1}$ and $g_{n+1}$. Therefore, the value $s_{gn}$ can be represented as follow.

$$s_{gn} = \tfrac{1}{2}(g_{n-1} + g_{n+1}) \quad (7)$$

$$= \tfrac{1}{4}(a_m + a_{m+1} - b_m - b_{m+1})$$

If the value $g_j^o$ is obtained according to the equation (6), it is possible to obtain $f_i^o$ by the equation (1). Since, however, $f_i^o=f_i$ and $g_j^o=g_j$, the rolling load variation values $f_i$ and $g_j$ due to the eccentricities of the backup rolls 21 and 24 can be obtained by the following equations, respectively.

$$f_i=a_i-g_j \quad \ldots (8)$$

$$g_j=\tfrac{1}{2}(a_i-b_i) \quad \ldots (9)$$

With the above matters in mind, the operation of the present invention will now be described.

First of all, the work rolls 22 and 23 are made in contact with each other and rotated under a load. At the same time, the contact of the relay 38 is opened by operating the console 37. Upon this operation, the load cell 29 provides the rolling load variation signal (FIG. 6(C)) which is sampled in the sampler 33 with the output pulse of the pulse generator 45 and the sampled signal is sequentially supplied through the A/D converter 34 to the computer 35 and memorized therein. The computer 35 calculates the memory content according to the principle of the second control method to obtain the respective rolling load variation values $u_T(\theta_T)$ and $u_B(\theta_B)$ due to the backup rolls 21 and 24 and to provide correspondencies of them to the rotation angles of the rolls 21 and 24 which are memorized in the form of a table.

Then, the sheet material 25 is inserted into between the work rolls 22 and 23 and the rolling operation is started. At the same time, the contact of the relay 38 is closed by supplying an instruction from the console 37. Upon the closure of the contact, the computer 35 provides a roll eccentricity compensation signal $\alpha\cdot\{u_T(\theta_T)+u_B(\theta_B)\}_1$ during the first rotation period of the upper backup roll 21. The signal is supplied through the D/A converter 36 and the contact of the relay 38 to the rolling force control device 30. As a result, the control device 30 controls the rolling force cylinder 26 through the servo valve 28 to compensate for the rolling load variation due to the eccentricity of the backup rolls 21 and 24.

The coefficient $\alpha$ is set as being $0<\alpha<1$ as mentioned before. Therefore, there may be a certain control error occurred when the rolling mill is controlled according to the above roll eccentricity compensation signal. According to the present invention, the rolling load variation due to the control error is detected according to the principle of the first control method and the detected variation is used in the subsequent roll rotation period as a portion of the roll eccentricity compensation signal therefore.

That is, the rolling load variation due to the control error in the first roll rotation period is detected by the load cell 29 in the same period and the result is memorized in the computer 35 as a function $V_1(\theta_T)$ where $\theta_T$ is the rotation angle of the upper backup roll 21. Then, in the second roll rotation period of the roll 21, $\alpha\cdot\{u_T(\theta_T)+u_B(\theta_B)\}_2+(1-\alpha)\cdot V_1(\theta_T)$ in used as the roll eccentricity compensation signal. A control error resulting from the control of the rolling mill based on the control signal in the second rotation period of the roll 21, i.e., the rolling load variation $V_2(\theta_T)$ in the second roll rotation period is detected by the load cell 29 and memorized similarly. And thus, $\alpha\cdot\{u_T(\theta_T)+u_B(\theta_B)\}_3+(1-\alpha)\cdot\{V_1(\theta_T)+V_2(\theta_T)\}$ is used as the roll eccentricity compensation signal in the third roll rotation period.

In the similar manner, the roll eccentricity compensation signals to be used in the fourth to n-th roll rotation periods become as follows, respectively.

$$\alpha\cdot\{u_T(\theta_T)+u_B(\theta_B)\}_4+(1-\alpha)\cdot\{V_1(\theta_T)+V_2(\theta_T)+V_3(\theta_T)\}$$

$$\alpha\cdot\{u_T(\theta_T)+u_B(\theta_B)\}_5+(1-\alpha)\cdot\{V_1(\theta_T)+V_2(\theta_T)+V_3(\theta_T)+V_4(\theta_T)\}$$

$$\vdots \qquad\qquad \vdots$$

$$\alpha\cdot\{u_T(\theta_T)+u_B(\theta_B)\}_n+(1-\alpha)\cdot\{V_1(\theta_T)+V_2(\theta_T)+\ldots+V_{n-1}(\theta_T)\}$$

The operations of obtaining the roll eccentricity compensation signals for the respective roll rotation periods are performed by the computer 35.

In the above embodiment, the sum of the signal which comprises $u(\theta_T, \theta_B)$ multiplied by $\alpha$ and the signal which comprises $V(\theta_T)$ multiplied by $(1-\alpha)$, i.e., the weighted mean of $u(\theta_T, \theta_B)$ and $V(\theta_T)$, is used as the roll eccentricity compensation signal. However, it is also possible to practicize the present invention by using $\beta$ instead of $(1-\alpha)$ as the roll eccentricity compensation signal, i.e., $\alpha\cdot u(\theta_T, \theta_B)+\beta\cdot V(\theta_T)$. In the latter case, $\alpha$ and $\beta$ are selected as being $0<\alpha<1$ and $0<\beta<1$, respectively, $\alpha$ and $\beta$ may be set at optimum values respectively on the basis of the output signal of the thickness detector 31.

As described hereinbefore, the present invention utilizes both of the first and second control methods and, therefore, has the merits of the two conventional methods. Therefore it becomes possible to obtain a more precise control of the roll eccentricity control than either of the two method, resulting in a higher quality of rolled product.

What is claimed is:

1. A method of controlling roll eccentricity of a rolling mill comprising the steps of obtaining, as a first roll eccentricity compensation signal, a rolling load variation signal due to eccentricity of backup rolls by removing a rolling load variation component due to a variation of thickness of a sheet material to be rolled from a rolling load variation signal detected during a rolling operation, obtaining a rolling load variation signal due to eccentricity of the backup rolls when the latter are made in contact with each other and rotated under a load, memorizing the latter rolling load variation signal as a second roll eccentricity compensation signal, obtaining a final roll eccentricity compensation signal for the rolling mill by multiplying the first roll eccentricity compensation signal with a constant larger than 0 and smaller than 1, multiplying the second roll eccentricity compensation signal with another constant larger than 0 and smaller than 1 and adding the results of the multiplications, and controlling the rolling mill with the final roll eccentricity compensation signal.

2. The method claimed in claim 1, wherein the final roll eccentricity compensation signal is a weighted mean of the first and second roll eccentricity compensation signals.

3. The method claimed in claim 1 or 2, further comprising the steps of detecting the thickness of the rolled sheet material and selecting optimum values of the constants to be multiplied with the first and second roll eccentricity compensation signals by using the detected thickness.

4. An apparatus for controlling roll eccentricity of a rolling mill comprising a load cell for detecting a rolling load variation, a first pulse generator for generating pulses with a rotation of an upper backup roll, a second pulse generator for generating pulses with a rotation of a lower backup roll, a pair of counters for counting the pulses generated by said first and second pulse generators to detect rotation angles of said upper and lower backup rolls, respectively, and a computer means for computing-out a roll eccentricity compensation signal, said computer means including a first means for obtaining a rolling load variation component due to the eccentricity of said upper and lower backup rolls by removing a rolling load variation component due to thickness variation of a sheet material to be rolled from the rolling load variation signal from said load cell during rolling operation, a second means for obtaining rolling load variation components due to the roll eccentricities of said respective backup rolls from the rolling load variation signal of said load cell under conditions that an upper and lower work rolls are made in contact with each other and rotated under a load and a multiplication-summation means for multiplying the rolling load variation components obtained by said first and second means with constants each larger than D and smaller than 1, respectively, and adding results of the multiplications.

5. The apparatus claimed in claim 4, further comprising means for detecting thickness of a rolled sheet material, the detected thickness being utilized to select optimum values of the constants.

* * * * *